US011217220B1

(12) United States Patent
Kapinos et al.

(10) Patent No.: US 11,217,220 B1
(45) Date of Patent: Jan. 4, 2022

(54) CONTROLLING DEVICES TO MASK SOUND IN AREAS PROXIMATE TO THE DEVICES

(71) Applicant: Lenovo (Singapore) Pte. Ltd., Singapore (SG)

(72) Inventors: Robert J. Kapinos, Durham, NC (US); Scott Wentao Li, Cary, NC (US); Robert Norton, Raleigh, NC (US); Russell Speight VanBlon, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/062,568

(22) Filed: Oct. 3, 2020

(51) Int. Cl.
*G10K 11/175* (2006.01)
*H04R 1/40* (2006.01)

(52) U.S. Cl.
CPC ..... *G10K 11/1752* (2020.05); *H04R 1/406* (2013.01)

(58) Field of Classification Search
CPC ..... G10K 11/1752; H04R 1/406
USPC ..... 381/73.1
See application file for complete search history.

(56) References Cited

U.S. PATENT DOCUMENTS

| | | | | |
|---|---|---|---|---|
| 2013/0259254 | A1 | 10/2013 | Xiang et al. | |
| 2015/0110278 | A1 | 4/2015 | Andersen | |
| 2015/0194144 | A1* | 7/2015 | Park | G10K 11/1754 381/73.1 |
| 2017/0026769 | A1 | 1/2017 | Patel | |
| 2017/0148466 | A1 | 5/2017 | Jackson et al. | |
| 2019/0166424 | A1 | 5/2019 | Harney et al. | |
| 2020/0312341 | A1 | 10/2020 | Alves et al. | |

OTHER PUBLICATIONS

Li et al., "Cancellation of Sound at First Device Based on Noise Cancellation Signals Received From Second Device", file history of related U.S. Appl. No. 16/793,640, filed Feb. 18, 2020.
Li et al., "Output of Babble Noise According to Parameter(s) Indicated in Microphone Input", file history of related U.S. Appl. No. 16/794,116, filed Feb. 18, 2020.

* cited by examiner

*Primary Examiner* — Paul Kim
(74) *Attorney, Agent, or Firm* — John M. Rogitz; John L. Rogitz

(57) ABSTRACT

In one aspect, an apparatus may include a processor and storage. The storage may include instructions executable by the processor to identify an intensity of sound at a device and to command the device to output noise according to the intensity to mask the sound. In some examples, the apparatus can be different from the device and the apparatus can control multiple devices to each output noise according to the intensity of the sound at the respective device to mask the sound in an area proximate to the respective device.

20 Claims, 4 Drawing Sheets

CONTROLLING DEVICES TO MASK SOUND IN AREAS PROXIMATE TO THE DEVICES

FIELD

The present application relates to technically inventive, non-routine solutions that are necessarily rooted in computer technology and that produce concrete technical improvements.

BACKGROUND

As recognized herein, open office environments are increasing in popularity. However, there are certain drawbacks to these environments, including that one person might be distracted by the conversation of others.

As a result, some facilities add constant ambiance, but as recognized herein that does not serve well when the sound is constant against varying noises. Accordingly, there are currently no adequate technological solutions to the foregoing problem, and non-technological solutions like erecting additional walls or other sound barriers frustrate the open office concept itself.

SUMMARY

Accordingly, in one aspect a first device includes at least one processor and storage accessible to the at least one processor. The storage includes instructions executable by the at least one processor to receive input indicating sound detected by respective microphones on second and third devices. The instructions are also executable to, based on the input, identify a location of the source of the sound and an intensity of the sound at the location. The instructions are further executable to identify fourth and fifth devices proximate to the source of the sound and to, based on identification of the fourth and fifth devices, control the fourth and fifth devices to output white noise according to the respective intensities of the sound at the respective fourth and fifth devices.

In some examples, the location of the source of the sound may be identified using triangulation and/or beamforming. Additionally, in some examples the intensity of the sound at the location may be identified using the inverse square law so that, e.g., the fourth and fifth devices may be controlled to output the white noise according to respective calculated intensities of the sound at the respective fourth and fifth devices.

In some example implementations, the fourth device may be the same as the second device and the fifth device may be the same as the third device. In some of these implementations, the first device may even be established by one of the second and third devices.

However, in other example implementations the fourth and fifth devices may be different from the second and third devices. The first device may be the same as one of the second and third devices.

Also in some example implementations, the instructions may be executable to, based on identification of the fourth and fifth devices, control the fourth and fifth devices to output white noise at intensities greater than the respective intensities of the sound at the respective fourth and fifth devices.

In another aspect, a method includes receiving input indicating sound detected by respective microphones on first and second devices and, based on the input, identifying a location of the source of the sound and an intensity of the sound at the location. The method also includes identifying third and fourth devices proximate to the source of the sound and, based on identification of the third and fourth devices, commanding the third and fourth devices to output noise according to the respective intensities of the sound at the respective third and fourth devices.

In various examples, the location of the source of the sound may be identified using triangulation, and the intensity of the sound at the location may be identified using the inverse square law. Also, in various examples, the noise may include babble noise and/or white noise.

Further, in some example implementations the method may include, based on the location of the source of sound and the intensity of the sound at the location, commanding a fifth device to lower the volume level at which it is outputting noise and/or to cease presenting noise.

In some example implementations, the third device may be the same as the first device and the fourth device may be the same as the second device, while in other example implementations the first, second, third, and fourth devices may be different from each other.

Still further, if desired the first, second, third, and fourth devices may be established by smart speakers.

In still another aspect, an apparatus includes at least one computer readable storage medium (CRSM) that is not a transitory signal. The CRSM includes instructions executable by at least one processor to receive input indicating sound detected by a microphone on a first device and based on the input, identify an intensity of the sound at the first device. The instructions are also executable to command the first device to output noise according to the intensity of the sound at the first device to mask the sound in an area proximate to the first device.

In some examples the instructions may be executed by a second device different from the first device, while in other examples the apparatus may include the first device.

Additionally, in some example implementations the instructions may be executable to receive input indicating sound detected by respective microphones on the first device and a second device and, based on the input, identify a location of the source of the sound and identify an intensity of the sound at the location. The instructions may then be executable to command third and fourth devices to output noise according to the respective intensities of the sound at the third and fourth devices to mask the sound in respective areas proximate to the third and fourth devices.

The details of present principles, both as to their structure and operation, can best be understood in reference to the accompanying drawings, in which like reference numerals refer to like parts, and in which:

DETAILED DESCRIPTION

Figure 1:
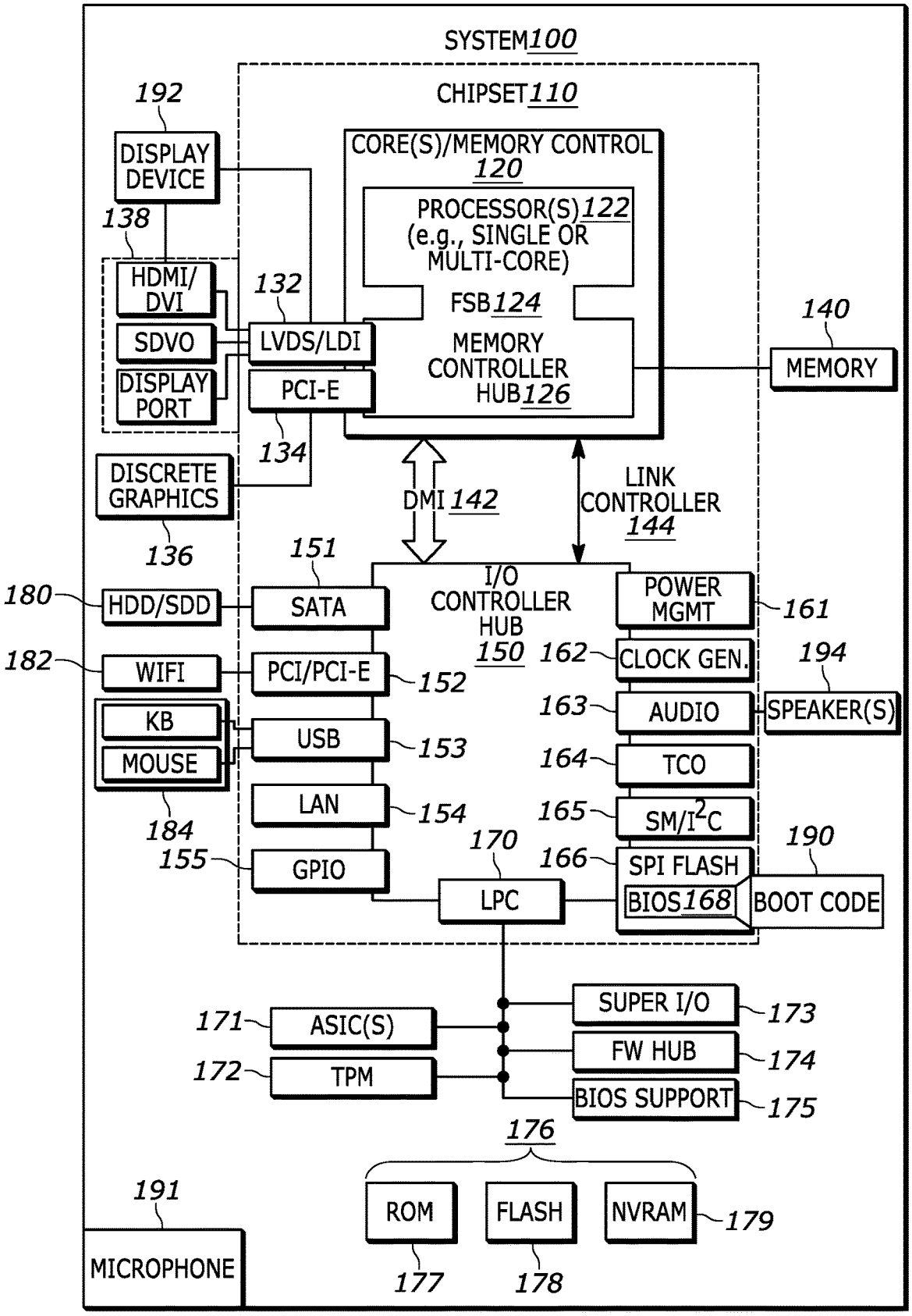
FIG. 1 is a block diagram of an example system consistent with present principles.

Among other things, the present application discloses using white noise generators in open landscapes and other environments, where the generators can be zoned and self-adjusting.

For example, each white noise generator may be equipped with a microphone and an IoT connection. The microphone may be set to send signals, with already-playing white noise acoustically echo cancelled out, to a central IoT controller. This controller may then use the various noise generator inputs to triangulate on sources of other sounds and the loudness of the sounds. The noise generators in the area of the sounds may then be adjusted so that they cover or mask the sounds. Those generators outside the sound source area may be adjusted lower in proportion to their respective distance from the source of the sound. In this way, the sound(s) may be masked with the lowest amount of white noise in each area.

Thus, for example, white noise generators may adjust to match the volume of locally heard white, ambient, or other noise. In some example implementations, a white noise controller may even be used that develops a field-based view of noise/sound sources. Application of field-based noise coverage may then be performed using a field of noise generators to hide noise/sound in an energy efficient, less intrusive manner.

Prior to delving further into the details of the instant techniques, note with respect to any computer systems discussed herein that a system may include server and client components, connected over a network such that data may be exchanged between the client and server components. The client components may include one or more computing devices including televisions (e.g., smart TVs, Internet-enabled TVs), computers such as desktops, laptops and tablet computers, so-called convertible devices (e.g., having a tablet configuration and laptop configuration), and other mobile devices including smart phones. These client devices may employ, as non-limiting examples, operating systems from Apple Inc. of Cupertino Calif., Google Inc. of Mountain View, Calif., or Microsoft Corp. of Redmond, Wash. A Unix® or similar such as Linux® operating system may be used. These operating systems can execute one or more browsers such as a browser made by Microsoft or Google or Mozilla or another browser program that can access web pages and applications hosted by Internet servers over a network such as the Internet, a local intranet, or a virtual private network.

As used herein, instructions refer to computer-implemented steps for processing information in the system. Instructions can be implemented in software, firmware or hardware, or combinations thereof and include any type of programmed step undertaken by components of the system; hence, illustrative components, blocks, modules, circuits, and steps are sometimes set forth in terms of their functionality.

A processor may be any general-purpose single- or multi-chip processor that can execute logic by means of various lines such as address lines, data lines, and control lines and registers and shift registers. Moreover, any logical blocks, modules, and circuits described herein can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can also be implemented by a controller or state machine or a combination of computing devices. Thus, the methods herein may be implemented as software instructions executed by a processor, suitably configured application specific integrated circuits (ASIC) or field programmable gate array (FPGA) modules, or any other convenient manner as would be appreciated by those skilled in those art. Where employed, the software instructions may also be embodied in a non-transitory device that is being vended and/or provided that is not a transitory, propagating signal and/or a signal per se (such as a hard disk drive, CD ROM or Flash drive). The software code instructions may also be downloaded over the Internet. Accordingly, it is to be understood that although a software application for undertaking present principles may be vended with a device such as the system 100 described below, such an application may also be downloaded from a server to a device over a network such as the Internet.

Software modules and/or applications described by way of flow charts and/or user interfaces herein can include various sub-routines, procedures, etc. Without limiting the disclosure, logic stated to be executed by a particular module can be redistributed to other software modules and/or combined together in a single module and/or made available in a shareable library.

Logic when implemented in software, can be written in an appropriate language such as but not limited to hypertext markup language (HTML)-5, Java/JavaScript, C# or C++, and can be stored on or transmitted from a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

The term "circuit" or "circuitry" may be used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

Now specifically in reference to FIG. 1, an example block diagram of an information handling system and/or computer system 100 is shown that is understood to have a housing for the components described below. Note that in some embodiments the system 100 may be a desktop computer system, such as one of the ThinkCentre® or ThinkPad® series of personal computers sold by Lenovo (US) Inc. of Morrisville, N.C., or a workstation computer, such as the ThinkStation®, which are sold by Lenovo (US) Inc. of Morrisville, N.C.; however, as apparent from the description herein, a client device, a server or other machine in accordance with present principles may include other features or only some of the features of the system 100. Also, the system 100 may be, e.g., a game console such as XBOX®, and/or the system 100 may include a mobile communication device such as a mobile telephone, notebook computer, and/or other portable computerized device.

As shown in FIG. 1, the system 100 may include a so-called chipset 110. A chipset refers to a group of integrated circuits, or chips, that are designed to work together. Chipsets are usually marketed as a single product (e.g., consider chipsets marketed under the brands INTEL®, AMD®, etc.).

In the example of FIG. 1, the chipset 110 has a particular architecture, which may vary to some extent depending on brand or manufacturer. The architecture of the chipset 110 includes a core and memory control group 120 and an I/O controller hub 150 that exchange information (e.g., data, signals, commands, etc.) via, for example, a direct management interface or direct media interface (DMI) 142 or a link controller 144. In the example of FIG. 1, the DMI 142 is a chip-to-chip interface (sometimes referred to as being a link between a "northbridge" and a "southbridge").

The core and memory control group 120 include one or more processors 122 (e.g., single core or multi-core, etc.) and a memory controller hub 126 that exchange information via a front side bus (FSB) 124. As described herein, various components of the core and memory control group 120 may be integrated onto a single processor die, for example, to make a chip that supplants the "northbridge" style architecture.

The memory controller hub 126 interfaces with memory 140. For example, the memory controller hub 126 may provide support for DDR SDRAM memory (e.g., DDR, DDR2, DDR3, etc.). In general, the memory 140 is a type of random-access memory (RAM). It is often referred to as "system memory."

The memory controller hub 126 can further include a low-voltage differential signaling interface (LVDS) 132. The LVDS 132 may be a so-called LVDS Display Interface (LDI) for support of a display device 192 (e.g., a CRT, a flat panel, a projector, a touch-enabled light emitting diode display or other video display, etc.). A block 138 includes some examples of technologies that may be supported via the LVDS interface 132 (e.g., serial digital video, HDMI/DVI, display port). The memory controller hub 126 also includes one or more PCI-express interfaces (PCI-E) 134, for example, for support of discrete graphics 136. Discrete graphics using a PCI-E interface has become an alternative approach to an accelerated graphics port (AGP). For example, the memory controller hub 126 may include a 16-lane (×16) PCI-E port for an external PCI-E-based graphics card (including, e.g., one of more GPUs). An example system may include AGP or PCI-E for support of graphics.

In examples in which it is used, the I/O hub controller 150 can include a variety of interfaces. The example of FIG. 1 includes a SATA interface 151, one or more PCI-E interfaces 152 (optionally one or more legacy PCI interfaces), one or more USB interfaces 153, a LAN interface 154 (more generally a network interface for communication over at least one network such as the Internet, a WAN, a LAN, a Bluetooth network using Bluetooth 5.0 communication, etc. under direction of the processor(s) 122), a general purpose I/O interface (GPIO) 155, a low-pin count (LPC) interface 170, a power management interface 161, a clock generator interface 162, an audio interface 163 (e.g., for speakers 194 to output audio), a total cost of operation (TCO) interface 164, a system management bus interface (e.g., a multi-master serial computer bus interface) 165, and a serial peripheral flash memory/controller interface (SPI Flash) 166, which, in the example of FIG. 1, includes BIOS 168 and boot code 190. With respect to network connections, the I/O hub controller 150 may include integrated gigabit Ethernet controller lines multiplexed with a PCI-E interface port. Other network features may operate independent of a PCI-E interface.

The interfaces of the I/O hub controller 150 may provide for communication with various devices, networks, etc. For example, where used, the SATA interface 151 provides for reading, writing or reading and writing information on one or more drives 180 such as HDDs, SDDs or a combination thereof, but in any case the drives 180 are understood to be, e.g., tangible computer readable storage mediums that are not transitory, propagating signals. The I/O hub controller 150 may also include an advanced host controller interface (AHCI) to support one or more drives 180. The PCI-E interface 152 allows for wireless connections 182 to devices, networks, etc. The USB interface 153 provides for input devices 184 such as keyboards (KB), mice and various other devices (e.g., cameras, phones, storage, media players, etc.).

In the example of FIG. 1, the LPC interface 170 provides for use of one or more ASICs 171, a trusted platform module (TPM) 172, a super I/O 173, a firmware hub 174, BIOS support 175 as well as various types of memory 176 such as ROM 177, Flash 178, and non-volatile RAM (NVRAM) 179. With respect to the TPM 172, this module may be in the form of a chip that can be used to authenticate software and hardware devices. For example, a TPM may be capable of performing platform authentication and may be used to verify that a system seeking access is the expected system.

The system 100, upon power on, may be configured to execute boot code 190 for the BIOS 168, as stored within the SPI Flash 166, and thereafter processes data under the control of one or more operating systems and application software (e.g., stored in system memory 140). An operating system may be stored in any of a variety of locations and accessed, for example, according to instructions of the BIOS 168.

Still further, the system 100 may include an audio receiver/microphone 191 that provides input from the microphone to the processor 122 based on audio that is detected consistent with present principles, such as the sound of people talking, the sound of ambient noise, the sound of music, etc.

Additionally, though not shown for simplicity, in some embodiments the system 100 may include a gyroscope that senses and/or measures the orientation of the system 100 and provides related input to the processor 122, as well as an accelerometer that senses acceleration and/or movement of the system 100 and provides related input to the processor 122. The system 100 may also include a camera that gathers one or more images and provides images and related input to the processor 122. The camera may be a thermal imaging camera, an infrared (IR) camera, a digital camera such as a webcam, a three-dimensional (3D) camera, and/or a camera otherwise integrated into the system 100 and controllable by the processor 122 to gather pictures/images and/or video. Also, the system 100 may include a global positioning system (GPS) transceiver that is configured to communicate with at least one satellite to receive/identify geographic position information and provide the geographic position information to the processor 122. However, it is to be understood that another suitable position receiver other than a GPS receiver may be used in accordance with present principles to determine the location of the system 100.

It is to be understood that an example client device or other machine/computer may include fewer or more features than shown on the system 100 of FIG. 1. In any case, it is to be understood at least based on the foregoing that the system 100 is configured to undertake present principles.

Figure 2:
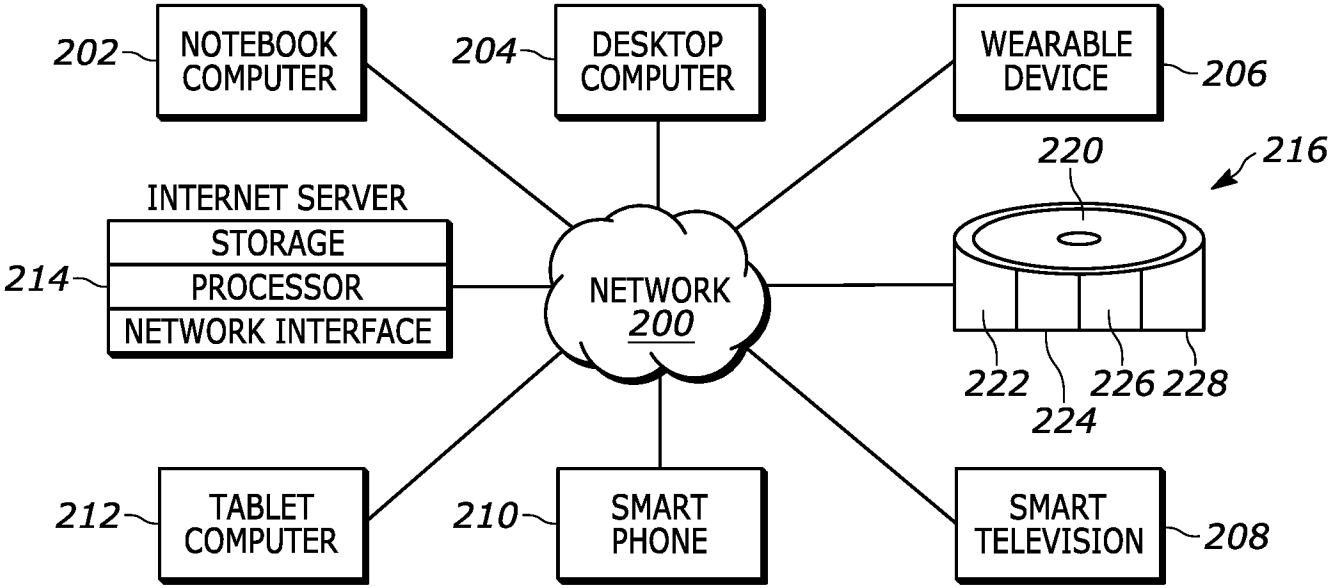
FIG. 2 is a block diagram of an example network of devices consistent with present principles.

Turning now to FIG. 2, example devices are shown communicating over a network 200 such as the Internet or a Bluetooth network in accordance with present principles. It is to be understood that each of the devices described in reference to FIG. 2 may include at least some of the features, components, and/or elements of the system 100 described above. Indeed, any of the devices disclosed herein may include at least some of the features, components, and/or elements of the system 100 described above.

FIG. 2 shows a notebook computer and/or convertible computer 202, a desktop computer 204, a wearable device 206 such as a smart watch, a smart television (TV) 208, a smart phone 210, a tablet computer 212, a smart speaker 216, and a server 214 such as an Internet server that may provide cloud storage accessible to the devices 202-212, 216. It is to be understood that the devices 202-216 may be configured to communicate with each other over the network 200 to undertake present principles.

Describing the smart speaker 216 in more detail, it may include an audio speaker 220 for outputting sound such as white or babble noise under control of a speaker processor 222. In various examples, babble noise may be established by prerecorded, indistinguishable voices of multiple people talking at the same time (e.g., "crowd noise"), while white noise may be prerecorded noise containing many frequencies with equal intensities.

The speaker 216 may also include storage 224 accessible to the processor 222 as well as a network interface 226 such as a Wi-Fi transceiver and/or Bluetooth transceiver for communicating with other devices consistent with present principles, including communicating with other smart speakers. The speaker 216 may further include a microphone or microphone array 228 that may operate consistent with present principles.

Figure 3:
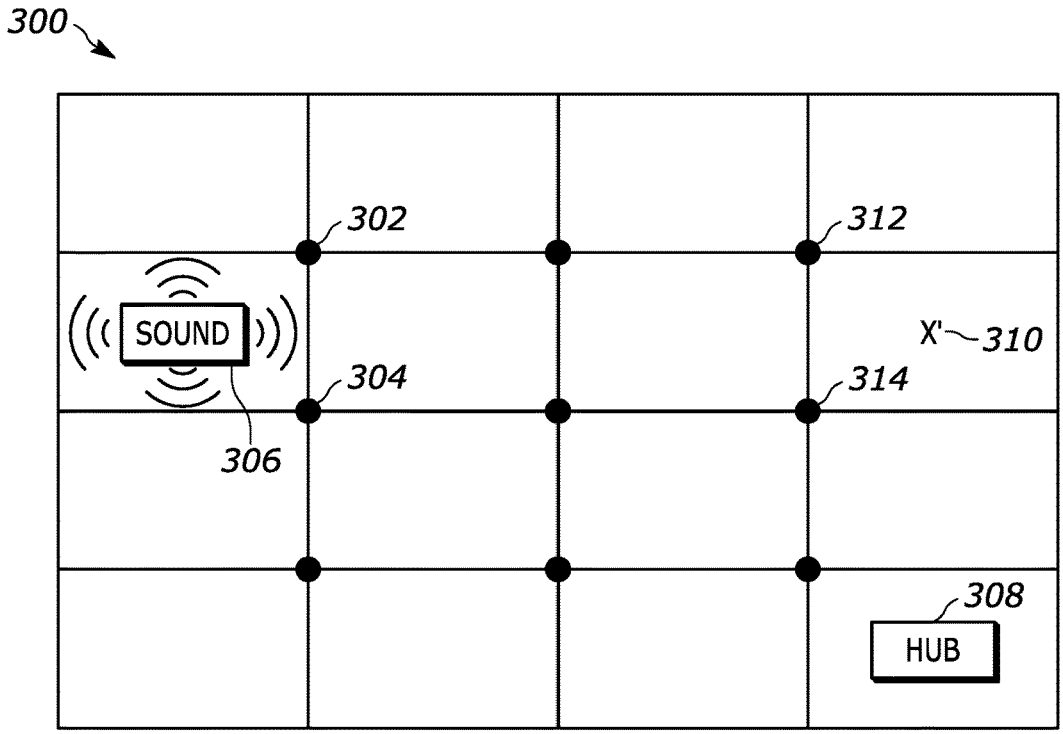
FIG. 3 is a schematic diagram of an example network of smart speakers and/or other IoT devices consistent with present principles.

Now describing FIG. 3, it shows a schematic diagram of an open-office environment 300. But note that present principles may also be applied in other settings as well, such as outdoor settings, in a personal residence, or even in a public transportation vehicle (e.g., bus, train, or subway car).

In any case, as shown in FIG. 3, various smart speakers that may be similar to the speaker 216 are shown arranged in grid format to establish an Internet of Things (IoT) speaker network. The speakers may be mounted into the ceiling of the office environment 300 (e.g., fifteen to twenty feet apart). However, the speakers may additionally or alternatively sit on respective desks of respective people, be mounted to respective cubicles of respective people, or even be speakers on headphones or headsets of respective people, etc.

In this example, two of the smart speakers (speakers 302 and 304) are most-proximate speakers to a source of sound 306, such as a group of people talking amongst each other. Consistent with present principles, the speakers 302, 304 may be controlled to output white noise or babble noise at a volume level that is a threshold amount greater than the intensity of sound from the group of people at the location of the respective speaker 302, 304 itself (as may have been detected by a respective microphone(s) in the respective speaker 302, 304). The threshold amount may be set by a system administrator or end-user, for example. The threshold amount may be established, e.g., as twenty or thirty decibels louder than the respective sound intensity at the respective speaker itself, or another amount suitable to mask sound from the source 306 within the proximity to the respective speaker 302, 304 even if a listening person is located between the source 306 and respective speaker 302, 304.

However, also note that in other examples the speakers 302, 304 may be controlled to output white noise or babble noise at a volume level that is equal to the intensity of sound from the group of people at the location of the respective speaker 302, 304 itself as detected by a respective microphone(s) in the respective speaker 302, 304.

The speakers 302, 304 themselves may run independently to detect sound intensities and control their respective outputs of the white or babble noise. Additionally, or alternatively, one of the speakers 302, 304 or even another one of the speakers on the grid may act as a coordinating device to control other speakers on the grid (e.g., in a peer-to-peer network). Still further, in addition to or in lieu of the foregoing, a hub device 308 may control speakers on the grid. The hub device 308 may be a local laptop or desktop computer, a server, a tablet computer, or any other device configured to manage Internet of Things (IoT) devices networked together via Wi-Fi, Bluetooth, etc. as shown. The hub device 308 may also be remotely located offsite, for example.

Further describing present principles, suppose in relation to FIG. 3 that the source of sound 306 was a group of people that had moved from another location within the environment 300, such as location 310. Also suppose that while at location 310, smart speakers 312, 314 had been actuated consistent with present principles to output babble noise or white noise to mask or otherwise render inaudible sound from the source 306 while the source 306 was at the location 310.

Then as the people making up the source 306 walk across the environment 300 (toward speakers 302, 304), smart speakers on the grid that become more proximate to the source 306 may be controlled to begin outputting white or babble noise or, if already outputting white or babble noise, to progressively increase the volume levels of their respective outputs as the source 306 gets progressively closer to locally mask sound from the source 306. Other smart speakers on the grid that become progressively farther away from the source 306 may also be controlled to progressively lower their respective outputs of white or babble noise to progressively lower volume levels as the source 306 moves away. Thus, the volume level at which white or babble noise is output by any given speaker on the grid may be proportional to the intensity of sound from the source 306 at that respective speaker as the source 306 moves closer or farther away.

Then in some examples, one or more of the smart speakers on the grid may be controlled to cease outputting their white or babble noise altogether if the intensity of sound from the source 306 at the respective speaker goes below a threshold decibel level (e.g., below fifteen decibels) and/or if sound from the source 306 is no longer detectable at that respective speaker using its respective microphone. This may be done to save energy. This may also be done so that people next to the respective speaker but no longer next to the source 306 itself need not hear the white or babble noise unnecessarily (since, e.g., they may no longer be able to hear sound from the source 306 at all).

Before moving on in the detailed description, also note that while the speakers of FIG. 3 are shown in grid format, they may also be located in concentric circle format. They may also be arranged in a random format (e.g., randomly spaced from each other) if the speakers are readily moveable within the environment 300 by people within the environment 300 like if they are wireless Bluetooth speakers with respective GPS transceivers for reporting their respective current locations. Other formats may be used as well.

Figure 4:
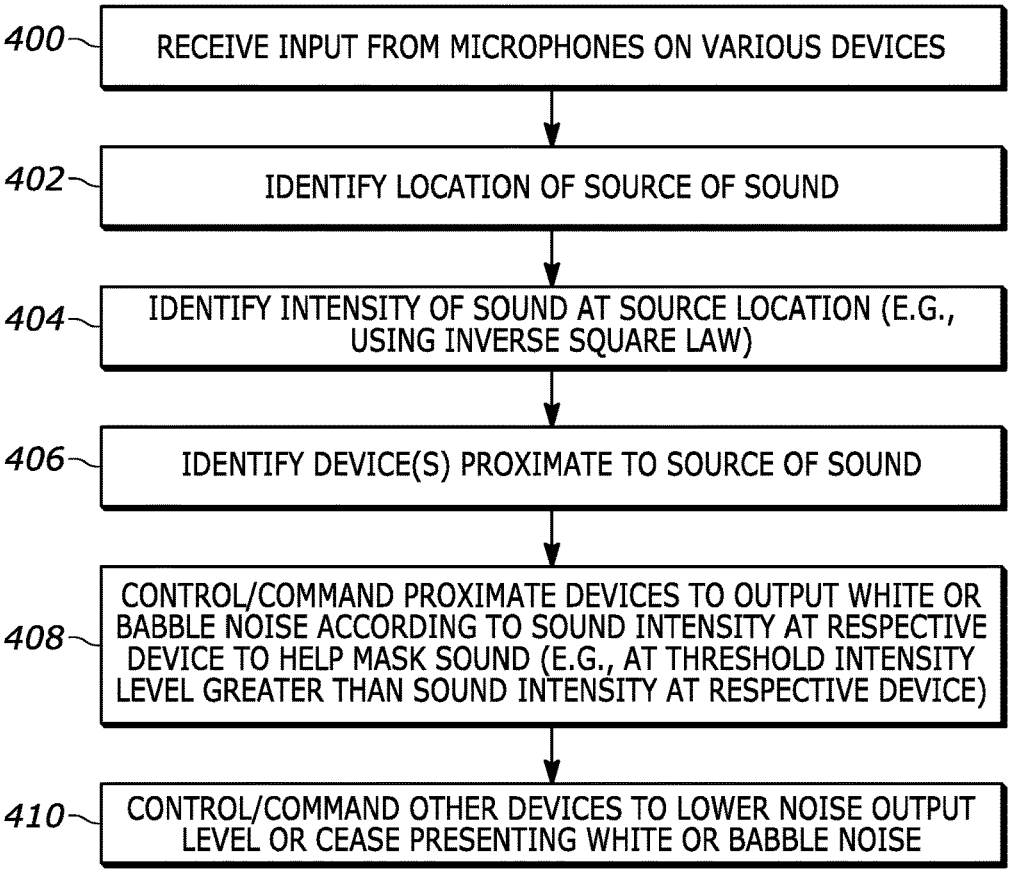
FIG. 4 is a flow chart of an example algorithm consistent with present principles.

Referring now to FIG. 4, it shows example logic that may be executed by a device such as the system 100 or any of the devices described in reference to FIG. 3 consistent with present principles. For example, the logic of FIG. 4 may be executed by a smart speaker IoT device or an IoT hub that controls various IoT devices.

Beginning at block 400, the device may receive input from one or more microphones on one or more IoT devices, such as smart speakers or even the telephone headsets or handsets of people in an open-office environment. Input from microphones on other types of devices may also be used, such as input from microphones on other types of IoT devices (e.g., smart refrigerators, digital assistant devices such as an Amazon Alexa or Google Assistant, etc.).

Additionally, note that in some examples the device executing the logic of FIG. 4, and/or the respective IoT device itself prior to transmitting its input to the device executing the logic of FIG. 4, may use audio processing software to echo-cancel or filter white or babble noise already being locally produced by the respective IoT device that generates the microphone input (and even any white or babble noise that is produced by other IoT devices nearby). This may be done so that the white or babble noise does not interfere with the determining of the intensity of sound from another source (such as people talking) as will be described below. Directional microphones and/or microphone arrays may also be used for filtering.

From block 400 the logic may then proceed to block 402. At block 402 the device may, based on the microphone input and the known locations of the microphones/IoT devices from which the input was received, triangulate the location of a source of a sound(s) that is indicated in the input. Locations may be known based on network topology data, based on the IoT devices reporting their locations in GPS coordinates, based on execution of a received signal strength algorithm (RSSI) to determine locations based on wireless communications from each device, etc.

Additionally or alternatively, in some examples the microphone of each IoT device providing input may actually be an array of microphones, with each individual microphone of the respective array being oriented in a different direction so that beamforming may be executed to report a direction in which the source of sound is located relative to the device. The beamforming may be executed by the respective IoT device itself or whatever device is executing the logic of FIG. 4. So, for example, the location of the source of sound may be derived from the beamforming by, for example, determining the location at which two vectors intersect that correspond to two respective directions to the source of sound from two differently-located IoT devices.

Still further, in some examples input from a camera may be used at block 402 to determine the location of the source of sound. For example, each IoT device may have its own respective camera and/or camera input may be received from still other devices such as augmented reality headsets or smart phones being used by people in the vicinity of the source of sound. Image analysis and/or object recognition may then be executed to identify the source of sound based on the camera input.

For example, if people are indicated in camera input as speaking, the device may determine the people as a source of sound. The location of the people may then be determined based on the camera's known orientation as well as spatial mapping to compare the size of the source of sound to the size of known objects also shown in the image(s) to derive a depth of the source of sound relative to the respective camera based on the size comparison. Inanimate objects that are also capable of producing sound may be identified from the camera input, and/or the inanimate object producing sound may itself report to other devices including the device of FIG. 4 that it is currently producing sound. Example inanimate objects that might produce sound include a smart copy machine, a smart scanner, or even a smart speaker or smartphone that is playing music.

From block 402 the logic may proceed to block 404. At block 404 the device may identify the intensity/power of the sound at the source location. This may be done using the inverse square law, the identified location of the source of sound, and both the detected intensity of the source of sound at one or more IoT devices (as detected by their microphones) as well as the known locations of those IoT devices. For example, the following equation may be used: $I=P/4\pi r^2$, where I is intensity, P is the sound power at the source location itself, and r is a radius established by the distance between the source location and the respective IoT device. However, also note that in some examples sound-dampening areas, reflection areas, and/or reverberation areas may also be accounted for using acoustic modelling techniques and the properties, dimensions, and locations of other objects within the environment (e.g., between the source of sound and respective microphone that sensed the sound).

Additionally or alternatively, if the source of sound is another device, the intensity of the sound at the sound's source may be identified based on the source itself reporting the sound's intensity in terms of a volume or decibel level at which the sound is being produced. A microphone on the source device may also be used to sense and report the volume or decibel level.

From block 404 the logic may then proceed to block 406. At block 406 the device executing the logic of FIG. 4 may identify other devices (e.g., IoT smart speakers) that are proximate to the source of sound. In various example implementations, proximate may be established as the sound itself being detectable by a microphone on the respective IoT device, or the sound being both detectable and above a threshold decibel level (e.g., fifteen decibels). Proximate may also be established as being within a distance range preconfigured by a system administrator or user (e.g., proximate may be configured as anything within fifty feet of the source, for example). Again, note that the locations of the IoT devices may be known from network topology information, GPS coordinates, etc. for determination of proximity in some examples.

From block 406 the logic may then proceed to block 408. At block 408 the device may control/command the devices determined to be proximate to the source of sound to output white noise or babble noise according to the sound intensity at the respective device to help mask the sound from the source. For example, at block 408 the device may command each respective IoT device to output white or babble noise at a volume/intensity level that is greater than the intensity of the sound itself at that respective device by a threshold amount (e.g., greater by thirty decibels). Or the volume level of the white or babble noise that is output may be equal to the intensity of the sound from the source at that respective IoT device. Or the volume level of the white or babble noise that is output may be proportional in some other way to the intensity of the sound at that respective IoT device, such as the volume level being output according to a 2:1 ratio where the white or babble noise level is double the intensity of the sound from the source at the respective IoT device.

From block 408 the logic may then proceed to block 410. At block 410 if desired the device executing the logic of FIG. 4 may control/command other IoT devices to lower their respective white or babble noise output levels or to cease presenting white or babble noise altogether. Here too the white or babble noise output level may be adjusted (down) proportional to the intensity of sound at the respective IoT device as described above.

Figure 5:
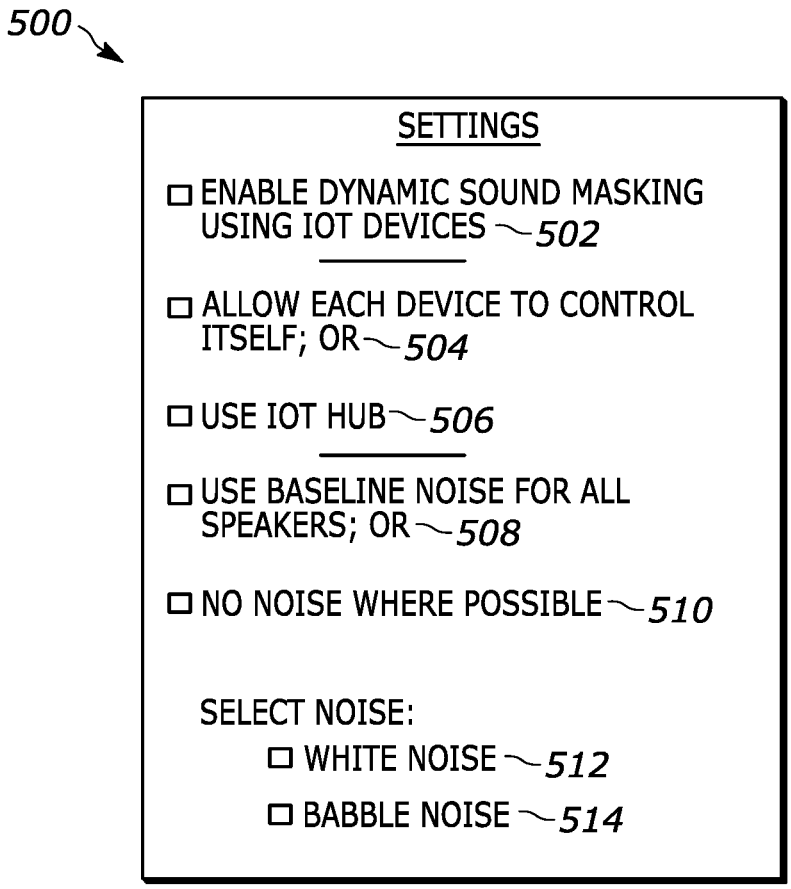
FIG. 5 is an example graphical user interface (GUI) that may be used for configuring one or more settings of a device or system operating consistent with present principles.

Now describing FIG. 5, it shows an example graphical user interface (GUI) 500 that may be presented on the display of a hub device, IoT device, or another device controlling an IoT network to set or configure one or more setting of the device/network consistent with present principles. Note that each option to be discussed below may be selected by directing touch or cursor input to the respective check box adjacent to the respective option.

As shown in FIG. 5, the GUI 500 may include a first option 502 that may be selectable to set or enable the device/network to, in the future, perform dynamic sound masking using IoT devices as described herein. For example, the option 502 may be enabled to set or configure a device to execute the functions described above in reference to FIG. 3 as well as to execute the logic of FIG. 4.

The GUI 500 may also include options 504, 506. Option 504 may be selected to set or enable the device to allow each respective IoT device on the network to control itself (e.g., independently execute the logic of FIG. 4 to control white or babble noise being output by that respective device). Alternatively, option 506 may be selected to set or enable a hub or coordinating device to command other IoT devices to operate consistent with present principles.

Still further, the GUI 500 may include options 508, 510. Option 508 may be selected to set or enable the device to use a baseline volume level (more than zero) for all IoT speakers in a given network regardless of sound intensity so that the speakers are all constantly outputting some low level of white or babble noise which may then increase from there per the intensity of sound from a particular source as described herein. Thus, the baseline may establish an ambient white or babble noise level for the environment, if one is desired. However, option 510 may be selected instead so that IoT speakers do not output any white or babble noise where possible and only do so per the intensity of sound from a particular source as described herein.

As also shown in FIG. 5, the GUI 500 may include options 512, 514. Option 512 may be selected to set or configure the IoT device(s) to use white noise to mask the sound from a sound source as described herein, while option 514 may instead be selected to set or configure the device to use babble noise.

It may now be appreciated that present principles provide for an improved computer-based user interface that improves the functionality and ease of use of the devices disclosed herein. The disclosed concepts are rooted in computer technology for computers to carry out their functions.

It is to be understood that whilst present principals have been described with reference to some example embodiments, these are not intended to be limiting, and that various alternative arrangements may be used to implement the subject matter claimed herein. Components included in one embodiment can be used in other embodiments in any appropriate combination. For example, any of the various components described herein and/or depicted in the Figures may be combined, interchanged, or excluded from other embodiments.

What is claimed is:

1. A first device, comprising:

at least one processor; and storage accessible to the at least one processor and comprising instructions executable by the at least one processor to:

receive input indicating sound detected by respective microphones on second and third devices;

based on the input, identify a location of the source of the sound and an intensity of the sound at the location;

identify fourth and fifth devices proximate to the source of the sound; and based on identification of the fourth and fifth devices, control the fourth and fifth devices to output white noise according to the respective intensities of the sound at the respective fourth and fifth devices.

2. The first device of claim 1, wherein the location of the source of the sound is identified using triangulation.

3. The first device of claim 1, wherein the location of the source of the sound is identified using beamforming.

4. The first device of claim 1, wherein the fourth device is the same as the second device and wherein the fifth device is the same as the third device.

5. The first device of claim 4, wherein the first device establishes one of the second and third devices.

6. The first device of claim 1, wherein the fourth and fifth devices are different from the second and third devices.

7. The first device of claim 1, wherein the first device is the same as one of the second and third devices.

8. The first device of claim 1, wherein the intensity of the sound at the location is identified using the inverse square law, and wherein the fourth and fifth devices are controlled to output the white noise according to respective calculated intensities of the sound at the respective fourth and fifth devices.

9. The first device of claim 1, wherein the instructions are executable to:

based on identification of the fourth and fifth devices, control the fourth and fifth devices to output white noise at intensities greater than the respective intensities of the sound at the respective fourth and fifth devices.

10. A method, comprising:

receiving input indicating sound detected by respective microphones on first and second devices;

based on the input, identifying a location of the source of the sound and an intensity of the sound at the location;

identifying third and fourth devices proximate to the source of the sound; and based on identification of the third and fourth devices, commanding the third and fourth devices to output noise according to the respective intensities of the sound at the respective third and fourth devices.

11. The method of claim 10, wherein the noise comprises one or more of: babble noise, white noise.

12. The method of claim 10, comprising:

based on the location of the source of sound and the intensity of the sound at the location, commanding a fifth device to one or more of: lower the volume level at which it is outputting noise, cease presenting noise.

13. The method of claim 10, wherein the third device is the same as the first device and wherein the fourth device is the same as the second device.

14. The method of claim 10, wherein the first, second, third, and fourth devices are different from each other.

15. The method of claim 10, wherein the first, second, third, and fourth devices are established by smart speakers.

16. The method of claim 10, wherein the location of the source of the sound is identified using triangulation and wherein the intensity of the sound at the location is identified using the inverse square law.

17. An apparatus, comprising:

at least one computer readable storage medium (CRSM) that is not a transitory signal, the CRSM comprising instructions executable by at least one processor to:

receive input indicating sound detected by respective microphones on first and second devices;

based on the input, identify a location of a source of the sound and identify an intensity of the sound at the location; and command third and fourth devices to output noise according to respective intensities of the sound at the third and fourth devices.

18. The apparatus of claim 17, wherein the instructions are executed by a fifth device different from the first and second devices, the apparatus comprising the fifth device.

19. The apparatus of claim 17, comprising the at least one processor and comprising the first, second, third, and fourth devices.

20. The apparatus of claim 17, wherein the noise comprises one or more of:

babble noise, white noise.

* * * * *